United States Patent [19]

Toft

[11] 4,115,935

[45] Sep. 26, 1978

[54] PLASTIC STEAM IRON

[75] Inventor: Kaj Toft, Monroe, Conn.

[73] Assignee: General Electric Company, Bridgeport, Conn.

[21] Appl. No.: 797,523

[22] Filed: May 16, 1977

[51] Int. Cl.[2] ..... D06F 75/36

[52] U.S. Cl. ..... 38/88

[58] Field of Search ..... 38/88, 89, 90, 91, 95, 38/82, 77.1, 77.3, 77.5, 77.8, 77.81, 77.83, 78

[56] References Cited

U.S. PATENT DOCUMENTS

| | | | |
|---|---|---|---|
| 3,413,741 | 12/1968 | Schwartz et al. | 38/78 |
| 3,755,649 | 8/1973 | Osrow | 38/82 |
| 3,811,208 | 5/1974 | Vicceli et al. | 38/88 X |
| 3,949,499 | 4/1976 | Schaeffer et al. | 38/77.3 |
| 3,969,607 | 7/1976 | Osrow et al. | 38/88 X |

*Primary Examiner*—Patrick D. Lawson

*Attorney, Agent, or Firm*—John F. Cullen; George R. Powers; Leonard J. Platt

[57] ABSTRACT

A lightweight steam iron having a soleplate and means to selectively deliver water thereto for distribution of steam from the soleplate. To this an improvement is provided comprising a first plastic skirt above the soleplate coextensive with the soleplate to form a skirt therearound, a second plastic housing having a handle and sealingly mounted on and supported by the skirt. The skirt and housing form the walls of an internal water tank and also enclose the iron operating components. The sealing mount is disposed along all the surface contacts between the plate and the housing and is formed with the sealing compound to provide a portion of the compound in compression on either expansion or contraction of the plastics to form a seal between the plastics at all time which plastics may have different coefficients of expansion.

6 Claims, 5 Drawing Figures

PLASTIC STEAM IRON

BACKGROUND OF THE INVENTION

1. Field of the Invention

This invention relates a lightweight steam iron using plastics usually of different coefficients of expansion and particularly to improved means for sealing between the plastics which provides for a sealing compound to be in compression on either expansion or contraction of the plastics to form a tight seal therebetween at all times.

2. Description of the Prior Art

Irons using plastic for as many parts as possible have come into general use. Typically, such irons may be electrolytic wherein a molded plastic contains an internal water tank with spaced electrodes generating steam and a separate or integral soleplate is provided as shown in U.S. Pat. Nos. 3,755,649 and 3,969,607. Other non-electrolytic irons using plastic parts forming the water tank for use with metallic soleplates generally seal the different plastics by using a conventional gasket therebetween and tightening down on the gasket as shown in U.S. Pat. No. 3,811,208. Still others may use plastic self-contained tanks in combination with metallic soleplates which tanks may be snapped into position and are removable and do not contact the hotter areas and such structures are shown in U.S. Pat. No. 3,413,741 and U.S. Pat. No. 3,949,499 of common assignment. Generally such irons do not encounter the problem of joining plastics with different coefficients of expansion and trying to seal them together to form a portion of the internal water tank. The use of such a mating plastic structure permits a reduction in parts over the prior art constructions.

SUMMARY OF THE INVENTION

It is an object of this invention to provide a lightweight steam iron using plastic construction where the plastics have different coefficients of expansion and joining them in a novel sealing structure that is always under compression to form a tight seal at all times.

Another object is to provide a seal between plastic parts of different coefficients of expansion which seal is always in compression on either expansion or contraction of the adjacent plastic components.

A final object is to provide a lightweight steam iron which uses different plastics for cost savings and provides a seal between the plastics so a tight water tank can be formed regardless of the differing rate of expansion or contraction of the plastics.

Briefly described, a lightweight steam iron is provided with a soleplate that may be metallic and has means to selectively deliver water through the soleplate for generation of steam and distribution therefrom. In this conventional structure, there is provided the improvement comprising a first plastic plate above the soleplate substantially coextensive with and forming a skirt around the soleplate closely adjacent to it. This is subject to the heat of the soleplate. A second plastic housing having a handle is sealingly mounted on and supported by the skirt and is farther removed from the heat of the soleplate. The skirt and housing form the walls of an internal water tank and also enclose the iron operating components. The plastics preferably are of a phenolic for the skirt to withstand the high heat of the soleplate and a polypropylene with a higher coefficient of expansion for the housing to reduce the cost of the iron. The joint between the two plastics is so formed to hold a sealing component such as silicone and provides a portion in compression on differential expansion or contraction of the plastics to form a tight seal at all times between the parts forming the water tank. Thus, the main object of the invention is to provide an iron of plastic construction wherein the water tank is formed by joining two separate plastic parts with a seal that is uniquely formed to be in compression at all times to be watertight even if the plastic parts expand and contract at different rates.

DESCRIPTION OF THE PREFERRED EMBODIMENT

Figure 1:
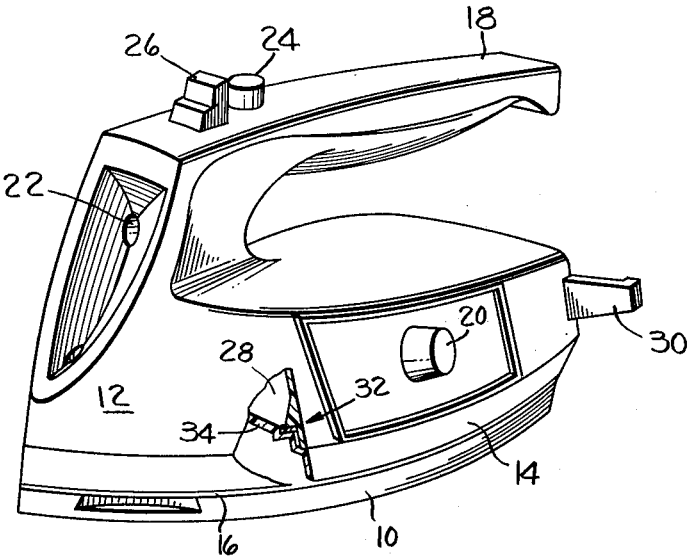
FIG. 1 is a perspective view of an iron with part broken away showing the seal between the plastic parts forming the water tank.

The invention is described in connection with a lightweight steam iron that uses a conventional aluminum soleplate although it will be appreciated that it is applicable to any iron using adjoining plastic parts wherein any tight seal is required such as to form an internal water tank. Referring first to FIG. 1, there is shown an electric steam iron that includes a soleplate 10 with a plurality of ports not shown to direct steam through the soleplate for steaming fabrics while ironing in the conventional manner. The iron is provided with a plastic housing 12 that comprises an exterior wall means positioned and fixed above the soleplate and suitably connected thereto. Between the housing 12 and soleplate there is provided a plastic plate 14 that is disposed directly above the soleplate and is substantially coextensive with the soleplate to form a skirt around it and spaced from the soleplate and supported thereon by conventional structure to provide an opening 16 for circulation of air. For manipulation, plastic housing 12 has a closed or open handle 18 that may be molded as part of the housing. In accordance with conventional practice, soleplate 10 is generally a material such as cast aluminum with an electrical heating element cast in the soleplate or secured thereto and which is controlled by a thermostatic knob means 20 suitably calibrated for the common fabrics with the iron being operable through a cord not shown all well known in the art. The iron is filled through an opening 22 and may have a spray feature or extra surge capacity operable by button 24 and the iron is operable dry or steaming depending on the position of control knob 26, which when in the up position as shown, permits water from an internal reservoir or tank 28 to selectively drip to deliver water into a boiler cavity for generation and subsequent distribution of steam all as well known. For storing, the iron can be tilted to its heel rest position where a suitable support means 30 provides stability.

In accordance with the invention, it is desired to use only two main plastic components such as housing 12 and a plate with skirt potion 14 and have them provide an internal water tank 28 as well as enclosing the iron operating components. While the same plastic materials may be used for both the skirt and housing, because of the proximity of the skirt 14 to the hot metallic soleplate 10, it is preferable to use a plastic that resists higher temperatures than on the upper housing structure 12 where the iron is generally cooler and a cheaper plastic. To this end, the iron preferably uses a low expansion phenolic plastic for skirt 14 and a polypropylene plastic for upper housing 12 and which has a higher coefficient of expansion. In operation the use of plastics of the same material may result in heat distortion or warping because of the various distances from the hot soleplate 10 resulting also in different rates of expansion on heat-up and cool-down. When different plastics are used as in the preferred construction, differential expansion takes place between skirt 14 and housing 12 with the housing expanding at a faster rate. In either case, the result is that it is difficult to form a tight seal at joint 32 between the plastics. In order to overcome this difficulty a specific sealing structure is provided which is under compression at all times regardless of whether the parts are expanding or contracting, or are changing at a differential rate. As seen in FIG. 1, the internal reservoir tank 28 has its bottom wall 34 formed by the skirt 14 and the other walls form the remainder of the tank such as the side wall 12 shown in FIG. 1. It can be seen that the housing 12 is mounted directly on and supported by the plastic plate with skirt portion 14. While any number of sides of the internal tank may be formed by either of the plastic components, the preferred form has skirt 14 forming the bottom wall and the housing 12 forming the remainder of the walls of the internal tank 28.

Figure 2:
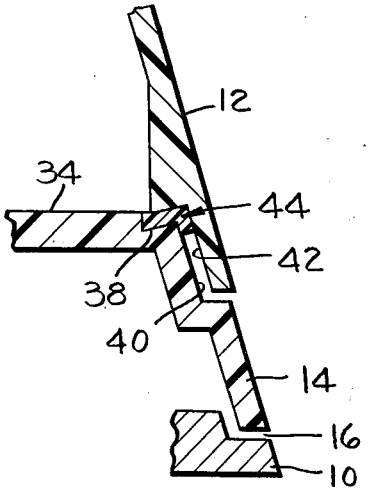
FIG. 2 is a part sectional view showing the plastic parts in normal position.
Figure 3:
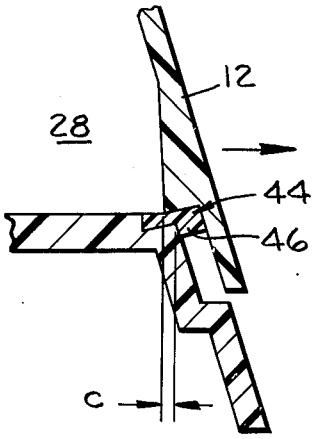
FIG. 3 is a view, similar to FIG. 2, showing the parts under differential expansion.
Figure 4:
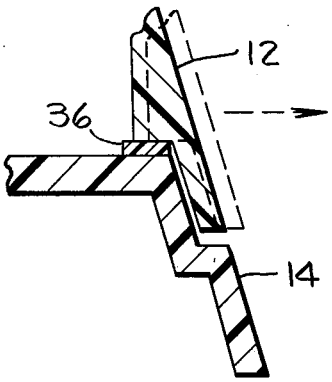
FIG. 4 is a modification showing the usual seal under differential expansion.

Normally the parts would be cemented or bolted together with a suitable gasket 36 disposed along all the surface contacts between the plate and housing as shown in FIG. 4. It can be seen that upon expansion of housing 12 at a faster rate than skirt 14, housing 12 moves to the dotted position which tends to pull it away from gasket 36 which is put under tension and this constant flexing back and forth tends to break the seal. To prevent this, the preferred construction of FIG. 2 is used. In this construction, a sloping groove 38 is provided around the entire contacting periphery of skirt 14 and this groove may be stepped as at 40 so that it is effectively a groove on the upper and outer periphery of skirt 14 as shown in FIG. 2. The housing is formed with a complementary step-shaped second groove 42 to mate or nest with or extend partially into the first groove so it is spaced from it to overlap on two sides for a smooth outer surface between housing 12 and skirt 14 as seen in FIG. 2 as well as another purpose to be explained. To provide a seal under compression at all times during differential expansion as the parts expand differentially from the position of FIG. 2 to FIG. 3 with housing 12 expanding faster than skirt 14, the groove is filled with a L-shaped sealing compound 44 that may be a silicone to fill the sealing space on at least two surfaces. For compression at all times, groove 38 is sloped down towards the center of the soleplate so that its outer periphery is higher than its inner periphery to form what I choose to call a braking angle between the plastic parts. Upon expansion to the position shown in FIG. 3, it will be apparent that the compound 44 is compressed in the area of C by the squeezing action or braking action (due to the braking angle) that prevents the compound from squeezing out or tearing. The extent of area C may be any amount desired depending on the braking angle and/or the width of the groove. On the reverse contracting movement of housing 12, the portion 46 of the sealing compound 44, will be compressed in the other part of the stepped portion of the groove thus, providing for compression of the compound on the upper periphery along area C on expansion and compression of the portion 46 of the compound around the outer periphery on contraction of housing 12 to form a tight seal at all times between the plate and housing for a watertight joint between the plastic parts. Thus, a complementary extension 48 provides a substantially smooth outer surface while also compressing a portion of the compound 46 after it moves back from the position of FIG. 3 to FIG. 2.

Figure 5:
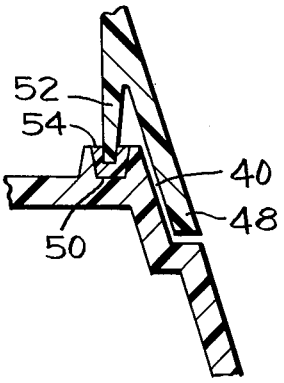
FIG. 5 is a modification to correct the condition of FIG. 4.

While the preferred form has been described in FIGS. 2 and 3, in view of this teaching, an evident modification is shown in FIG. 5 where a mortise and tenon type construction may be used with a continuous groove 50 around the upper surface of skirt 14 and the extension 52 extends into the groove 50 filled with sealing compound 54. In this case, the outer periphery or step groove 40 accommodates extension 48 for a substantially smooth outer surface. In this arrangement the extension 52 will compress the sealing compound on its' right side on expansion to the right and, in turn, compress the left side at 54 on contraction thus providing a tight seal in either case. By providing the groove around all the contacting surfaces between the plastics, it is possible to provide a sealing compound that is substantially always under compression for a good seal on either warped surfaces or on differential expansion between the parts. The overlapping arrangement to provide the area C as well as the compound seal at 46 results in compression of a portion in either expansion or contraction respectively. Thus, the invention provides a unique joint between two plastic parts that may warp or expand at different rates and permits such parts to be joined together to form a watertight internal reservoir by putting the sealing compound always under compression whether the parts are expanding or contracting.

While I have hereinbefore shown preferred forms of the invention, obvious equivalent variations are possible in light of the above teachings. It is therefore to be understood that, within the scope of the appended claims, the invention may be practiced otherwise than as specifically described, and the claims are intended to cover such equivalent variations.

I claim:

1. A lightweight steam iron having a soleplate and means to selectively deliver water thereto for distribution of steam therefrom, the improvement comprising a first plastic plate above the soleplate substantially coextensive therewith and having a portion forming a skirt therearound, a second plastic housing having a handle and sealingly mounted on and supported by said plate, said plate and housing forming the walls of an internal water tank and enclosing the iron operating components, and said sealing mount being disposed along all surface contacts between the plate and housing and formed to provide a portion always under compression on different rates of expansion or contraction of said plastics to form a seal therebetween at all times.

2. Apparatus as described in claim 1 wherein said plate forms at least the bottom and the housing the other sides of said water tank and said plastics have different coefficients of expansion.

3. Apparatus as described in claim 2 wherein said seal comprises a sloping groove on one of the plastic components and a complementary mating groove on the other plastic component, a sealing compound between said grooves, said grooves forming a braking angle between the plastics for always compressing the compound for a seal at all times on differential expansion of the components.

4. Apparatus as described in claim 2 wherein said sealing mount includes a groove in one of said plastic components around the entire contacting periphery, a complementary extension on the other plastic component extending partially into said groove, and a sealing compound filling the groove whereby the extension always compresses a portion of said compound on both differential plastic expansion and contraction to form a seal between said plastic components at all times.

5. Apparatus as described in claim 4 wherein said first plate is a low expansion plastic and the second housing is a higher expansion plastic, said groove comprising a first step-shaped groove on the upper and outer contacting periphery, the upper surface of the groove sloping down and in towards the center of the soleplate, said extension comprising a complementary step-shaped second groove nesting in said first groove, said sealing compound being disposed between and on at least two surfaces of the grooves, whereby expansion compresses the compound on the upper periphery and contraction compresses the compound on the outer periphery to form a seal between the plate and housing at all times on differential movement between the plastics.

6. Apparatus as described in claim 4 wherein said first plastic plate is a low expansion phenolic and the second plastic housing is a high expansion polypropylene, said groove comprising, a first continuous groove around the contacting periphery of said first plate, said groove being sloped down towards the center of the soleplate with its other periphery higher than its inner periphery, said extension comprising a complementary second groove on said second plastic spaced from said first groove and overlapping the groove on two sides, an L-shaped sealing compound in the grooves whereby differential plastic expansion and contraction always compresses said compound at all times to form a seal.

* * * * *